US007458766B2

(12) United States Patent
Dailey et al.

(10) Patent No.: US 7,458,766 B2
(45) Date of Patent: Dec. 2, 2008

(54) TURBINE BLADE COOLING SYSTEM

(75) Inventors: Geoffrey M Dailey, Derby (GB); Guy D Snowsill, Derby (GB)

(73) Assignee: Rolls-Royce plc, London (GB)

( * ) Notice: Subject to any disclaimer, the term of this patent is extended or adjusted under 35 U.S.C. 154(b) by 464 days.

(21) Appl. No.: 11/252,714

(22) Filed: Oct. 19, 2005

(65) Prior Publication Data

US 2006/0104808 A1 May 18, 2006

(30) Foreign Application Priority Data

Nov. 12, 2004 (GB) ..... 0424979.3

(51) Int. Cl.
*F03B 11/00* (2006.01)

(52) U.S. Cl. ..... 415/1; 415/115; 415/175; 415/116; 416/97 R

(58) Field of Classification Search ..... 415/115, 415/116, 173.4, 173.7, 174.4, 174.5; 416/95, 416/96 R, 97 R, 220 R
See application file for complete search history.

(56) References Cited

U.S. PATENT DOCUMENTS 2,750,147 A * 6/1956 Smith ..... 416/90 R
4,217,755 A * 8/1980 Williams ..... 415/115
4,236,869 A 12/1980 Laurello
4,708,588 A * 11/1987 Schwarz et al. ..... 415/115
4,825,643 A * 5/1989 Hennecke et al. ..... 415/115
4,882,902 A 11/1989 Reigel
5,232,335 A 8/1993 Narayana
5,575,616 A 11/1996 Hagle
5,984,636 A 11/1999 Fahndrich
6,464,453 B2 * 10/2002 Toborg et al. ..... 415/115
6,554,570 B2 * 4/2003 Dailey ..... 416/1

FOREIGN PATENT DOCUMENTS

GB 1 541 533 SP 3/1979
GB 2 075 123 A 11/1981
GB 2 309 269 A 7/1997

* cited by examiner

*Primary Examiner*—Igor Kershteyn
(74) *Attorney, Agent, or Firm*—W. Warren Taltavull; Manelli Denison & Selter PLLC

(57) ABSTRACT

Efficient cooling of a stage of gas turbine engine turbine blades (36) is achieved by first reducing the pressure of the cooling air after it has been bled from the annulus of the compressor (12) by passing it through a diffuser (30), to a pressure magnitude lower than is required at entry to the turbine blades, then re-pressurizing the bled air up to the required entry pressure, by passing it through a radial compressor defined by a cowl (44) positioned in close spaced, co-rotational relationship with the downstream face of the associated turbine disk (34).

10 Claims, 2 Drawing Sheets

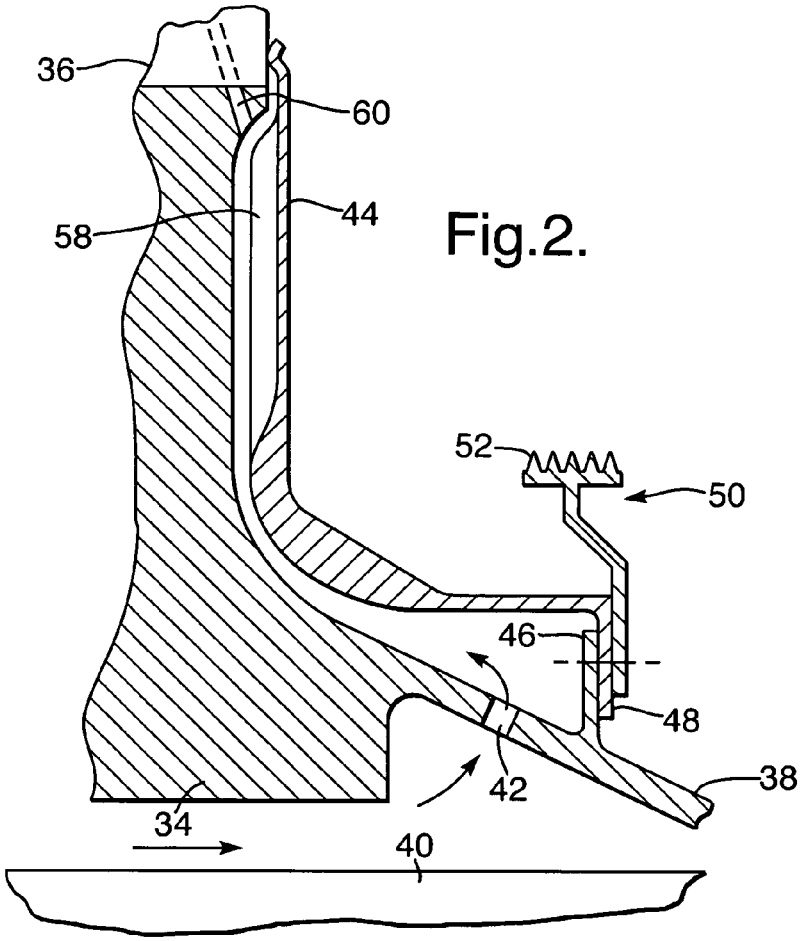
Fig.2.
Fig.3.
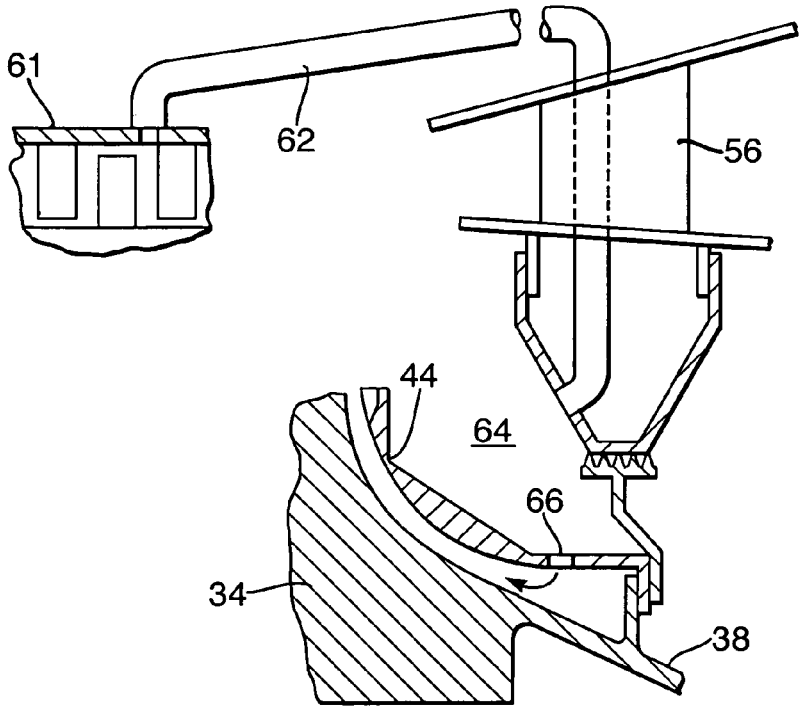

TURBINE BLADE COOLING SYSTEM

FIELD OF THE INVENTION

The present invention relates to the cooling of turbine blades in a gas turbine engine. In particular, the present invention relates to a turbine blade cooling system wherein air bled from a compressor of an associated gas turbine engine, is passed to a stage of turbine blades carried on a rotary disk.

BACKGROUND OF INVENTION

It is known, to achieve turbine blade cooling by bled compressor air, which air is passed to the respective blade roots via holes in the rim of the associated turbine disk. However, such known systems suffer from the disadvantage of delivering the cooling air to the blades roots at pressures which are often not appropriate to the blades cooling requirements. Therefore, the present invention seeks to provide an improved turbine blade cooling system.

SUMMARY OF THE INVENTION

According to the present invention, a turbine blade cooling system comprises a compressor having a stage of compressor blades and compressed air bleed means, a stage of turbine blades downstream of said compressor and supported on a disk, a cowl covering the downstream face of said disk in spaced, co-rotatable relationship therewith, bled compressor air diffusion means connected in flow series with said spaced, holes in the rim of said disk, which holes connect said space with the roots of said blades, and wherein the inner surface of said cowl is formed so as to pressurise said diffused compressor air to a magnitude appropriate to the cooling flow requirements of said turbine blades.

Preferably said compressor has a plurality of stages and said bleed means is positioned so as to bleed air from a stage upstream of the final stage thereof.

BRIEF DESCRIPTION OF THE DRAWINGS

The invention will now be described, by way of example and with reference to the accompanying drawings, in which:

FIG. 2 is an enlarged axial cross sectional part view of the turbine disk and cowl in FIG. 1 in accordance with the present invention, and:

FIG. 3 is an axial cross sectional part view of the turbine disk of FIG. 2 incorporating an alternative form of compressor air delivery thereto and in accordance with the present invention.

DETAILED DESCRIPTION OF THE INVENTION

Figure 1:
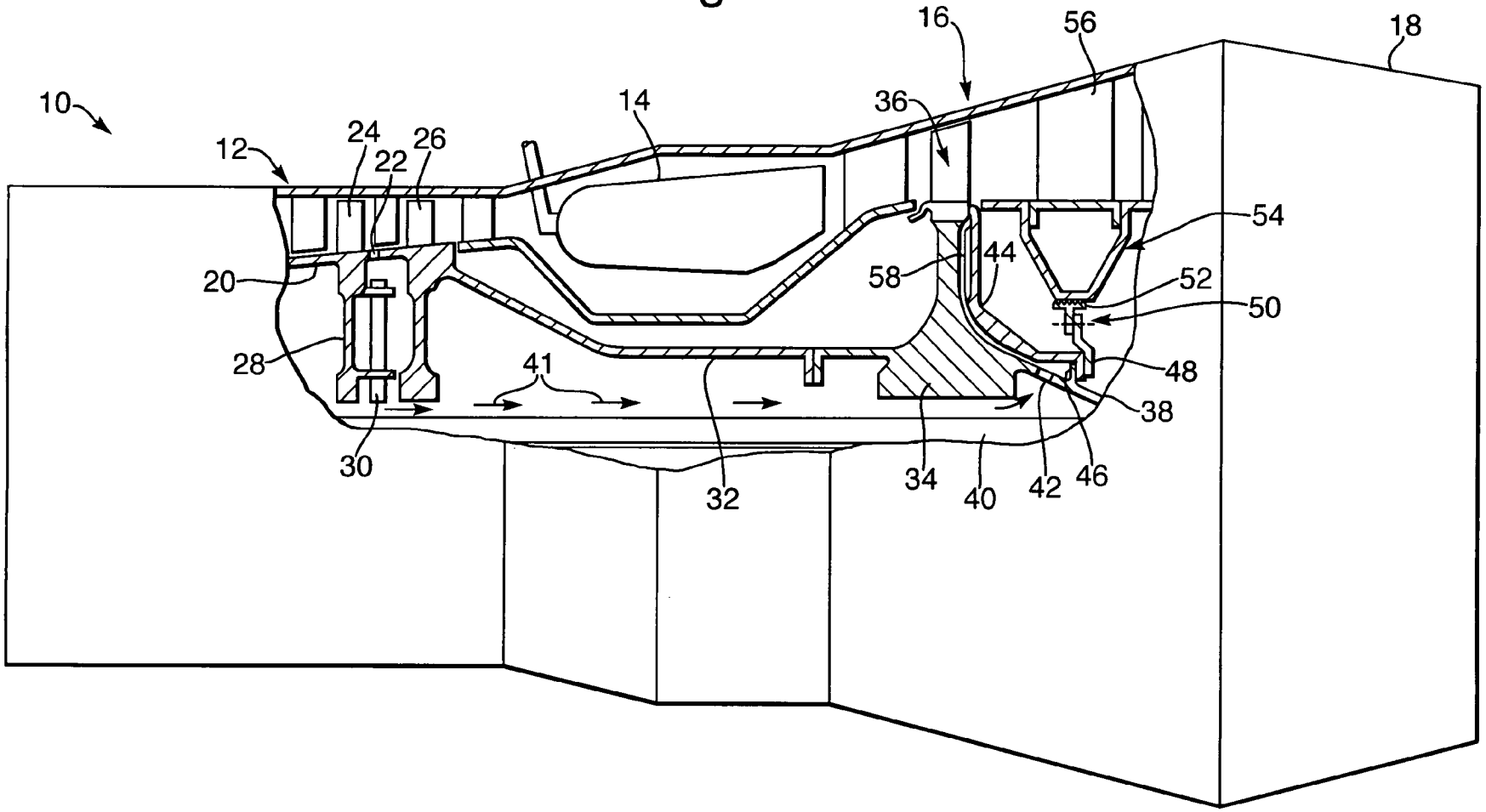
FIG. 1 is an axial cross sectional view through a gas turbine engine including a turbine blade cooling system in accordance with the present invention.

Referring to FIG. 1. A gas turbine engine 10 has a multi stage compressor 12, combustion equipment 14, a turbine section 16 and an exhaust nozzle 18. The inner annulus wall 20 of compressor 12 has a number of equiangularly spaced bleed holes 22 therethrough, only one of which holes is shown. In the present example, bleed holes 22 are positioned between the penultimate and ultimate stages of compressor blades 24 and 26.

The stage of compressor blades 24 is carried on a disk 28, which also supports a radial turbine 30 for co-rotation therewith, during operation of gas turbine engine 10. Compressor

12 is connected via an annular cross-section shaft 32 to a disk 34 that carried turbine stage 36 for rotation thereby, during the said operation of gas turbine engine 10. An annular cross-section stub shaft 38 extends from the downstream side (with respect to the direction of gas flow through engine 10) of disk 34, and a bearing (not shown) maintains that stub shaft 38 in axial spaced relationship in known manner, with a central shaft 40. Stub shaft 38 has a plurality of holes 42 therethrough, that are equi-angularly spaced about the stub shaft axis.

A cowl 44 which in shape follows the profile of the downstream face of disk 34, is fixed to stub shaft 38 via abutting flanges 46, 48. The opposing faces of disk 34 and cowl 44 are spaced apart for reasons that are explained later in this specification. An annular labyrinth seal 50 is also flange jointed to flanges 46 and 48, the seal portion 52 itself nesting within a bore defined by structure 54 fixed to the underside of a stage of nozzle guide vanes 56, immediately downstream of turbine stage 36.

During operation of gas turbine engine 10, the aim is to present a cooling air flow from compressor 12 to the roots of the blades in turbine stage 36, at a pressure appropriate to their needs. Delivery of cooling air at excessive pressure can result in back pressure with erratic flow through the blades, and turbulance in the turbine annulus. Avoidance of such conditions is achieved by positioning holes 22 immediately downstream of a stage of compressor 12, e.g. stage 24, where the pressure of the air bled therethrough, though higher than that required at the delivery point, is sufficiently low as to enable its further lowering by diffusion it to a magnitude below the pressure required. The diffusion is effected by passing the bled air radially inwards through the radial turbine 30, into the annular space defined by shafts 32 and 40. Thereafter, the diffused air flows downstream in the direction of arrows 41, and through the holes 42, into the space between disk 34 and cowl 44. The radially outer portion of the inner surface of cowl 44 has vanes 58 formed thereon, which vanes are so shaped as to pressurise the bled air as it flows therethrough. The design of the vanes 58 is such as to raise the pressure of the bled air to that required at its point of entry into the blade roots of the turbine stage 36.

Referring to FIG. 2, the bled air flow path between disk 34 and cowl 44 can be seen more clearly, as can one of the vanes 58 on the inner surface of cowl 44. The re-pressurised air flows therefrom via holes 60 drilled through the rim of disk 34, into the roots of the blades of turbine stage 36.

Referring to FIG. 3. In this example of the present invention compressor air is bled through the outer annulus wall 61, and piped through diffuser conduits 62 to and subsequently through the interior of each guide vane in the stage of guide vanes 56, and exits into space 64. Thereafter, the bled air flows through holes 66 in cowl 44, to the space defined by disk 34 and cowl 44, and is re-pressurised as described with respect to FIGS. 1 and 2.

In the FIG. 1 example, radial turbine 30 could be substituted by a frustoconical cowl (not shown), which would control the rate of expansion, and thereby, the pressure drop of the bled air.

We claim:

1. In a gas turbine engine, a turbine blade cooling system comprises a compressor having a stage of compressor blades and compressed air bleed means, a stage of turbine blades downstream of said compressor, a disk, said stage of turbine blades being supported on said disk, a cowl covering the downstream face of said disk in spaced, co-axial relationship therewith, bled compressor air diffusion means connected in flow series with said space, holes in the rim of said disk, which holes connect said space with the roots of said turbine blades, and wherein the inner surface of said cowl is formed so as to pressurize said diffused air to a magnitude appropriate to the cooling flow requirements of said turbine blades wherein the cowl is vaned to define a radial compressor.

2. The turbine blade cooling system as claimed in claim 1 wherein said compressed air bleed means connects the compressor annulus in flow series with the space between said turbine disk and said cowl.

3. The turbine blade cooling system as claimed in claim 2 wherein said compressor air bleed means comprises holes through the inner wall of the compressor annulus.

4. The turbine blade cooling system as claimed in claim 1 wherein said bled compressor air diffusion means comprises a conical member.

5. The turbine blade cooling air system as claimed in claim 4 wherein said conical member is mounted for co-rotation on the disk of the stage of compressor blades immediately upstream of said compressor air bleed means.

6. In a gas turbine engine, a turbine blade cooling system comprises a compressor having a stage of compressor blades and compressed air bleed means, a stage of turbine blades downstream of said compressor, a disk, said stage of turbine blades being supported on said disk, a cowl covering the downstream face of said disk in spaced, co-axial relationship therewith, bled compressor air diffusion means connected in flow series with said space, holes in the rim of said disk, which holes connect said space with the roots of said turbine blades, and wherein the inner surface of said cowl is formed so as to pressurize said diffused air to a magnitude appropriate to the cooling flow requirements of said turbine blades wherein said bled compressor air diffusion means comprises a radial turbine.

7. The turbine blade cooling system as claimed in claim 6 wherein said radial turbine is co-rotatably mounted on the disk of the compressor stage immediately upstream of said compressor air bleed means.

8. In a gas turbine engine, a turbine blade cooling system comprises a compressor having a stage of compressor blades and compressed air bleed means, a stage of turbine blades downstream of said compressor, a disk, said stage of turbine blades being supported on said disk, a cowl covering the downstream face of said disk in spaced, co-axial relationship therewith, bled compressor air diffusion means connected in flow series with said space, holes in the rim of said disk, which holes connect said space with the roots of said turbine blades, and wherein the inner surface of said cowl is formed so as to pressurize said diffused air to a magnitude appropriate to the cooling flow requirements of said turbine blades wherein said compressor air bleed means comprises holes in the outer wall of the compressor annulus.

9. The turbine blade cooling system as claimed in claim 8 wherein said bled compressor air diffuser comprises external diffuser pipes connecting said bled compressor air, via the interiors of a corresponding number of hollow turbine guide vanes, to said space between said turbine disk and associated cowl.

10. A method of cooling a stage of gas turbine engine turbine blades comprising the steps of first reducing the pressure of cooling air bled from an associated compressor by passing it through a diffuser so as to achieve a pressure lower than is required at entry to the turbine blades, then re-pressurizing said bled air up to the required entry pressure by passing it through a radial compressor defined by a vaned cowl positioned in close spaced, co-rotational rotational relationship with the downstream face of the associated turbine disk.

* * * * *